United States Patent [19]

Warwick

[11] Patent Number: 4,953,249

[45] Date of Patent: Sep. 4, 1990

[54] MODULAR OVERPASS OR RAISED PARKING STRUCTURE

[76] Inventor: Jack A. Warwick, #103-1515 Chesterfield Avenue, North Vancouver, British Columbia, Canada, V7M 2N5

[21] Appl. No.: 405,199

[22] Filed: Sep. 11, 1989

[51] Int. Cl.[5] ..... E01D 15/00

[52] U.S. Cl. ..... 14/2.4; 14/1; 14/17; 14/73; 14/74; 404/1; 404/71

[58] Field of Search ..... 404/1, 18, 28, 29, 30, 404/34, 35, 36, 40, 41, 43, 53, 54, 56, 60, 61, 70, 71, 42, 44, 50, 173; 14/2.4, 3, 4, 5, 6, 7, 13, 16.1, 16.5, 2, 17, 69.5, 1, 71.1; 414/227, 228, 254, 919, 252; 105/425; 52/87, 404, 408, 433, 437, 440, 441, 447, 576, 578, 585, 586, 595, 174, 175, 223 R, 251; 238/8, 12

[56] References Cited

U.S. PATENT DOCUMENTS

| | | | |
|---|---|---|---|
| 2,225,186 | 12/1940 | Sorensen | 404/1 |
| 3,662,656 | 5/1972 | Finsterwalder et al. | 40/570 |
| 4,181,995 | 1/1980 | Zur | 14/1 |
| 4,592,673 | 3/1985 | Lee | 404/1 |

*Primary Examiner*—Jerome W. Massie
*Assistant Examiner*—Roger J. Schoeppel

[57] ABSTRACT

A modular overpass that uses interlockable roadway units. These interlockable units include ramp units adapted for fitting together to create entry and exit ramps having a low end and a raised end, cantilever units for attachment to the raised ends of the ramps, and suspended span units for joining the cantilever units. Flexible footings are provided to support the roadway units. The flexible footings comprise a resilient base, a covering cap sealably fitted over the base to define a cavity, and a packable bearing material partially filling the cavity. A system of pilings are used to anchor the roadway units in position. The system can be used to create an overpass over intersections between highways and secondary roads so that highway traffic travels over the overpass and local secondary road traffic is controlled by traffic lights. The modular overpass is shaped to conform to the existing highway surface and is supported on that surface by the flexible footings. A raised parking lot structure can also be constructed using the flexible footings of the present invention and a modified form of interlockable units that form an essentially level parking surface.

24 Claims, 11 Drawing Sheets

Fig. 18.
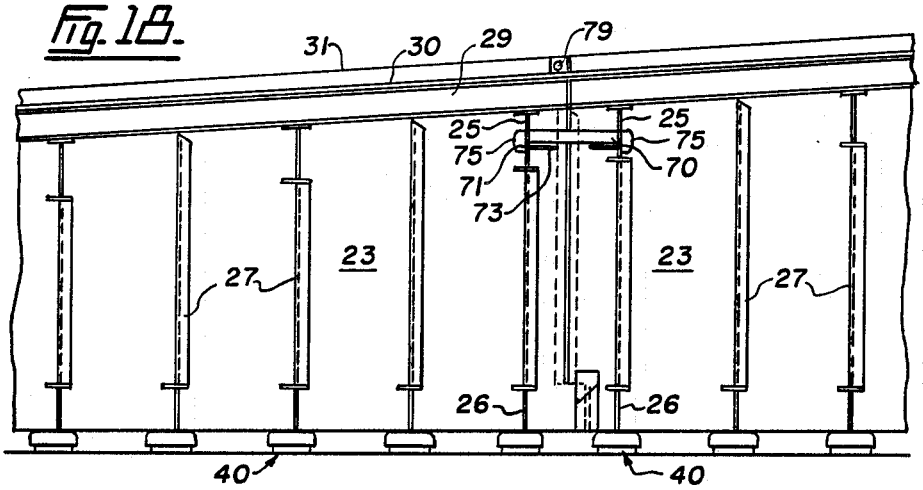
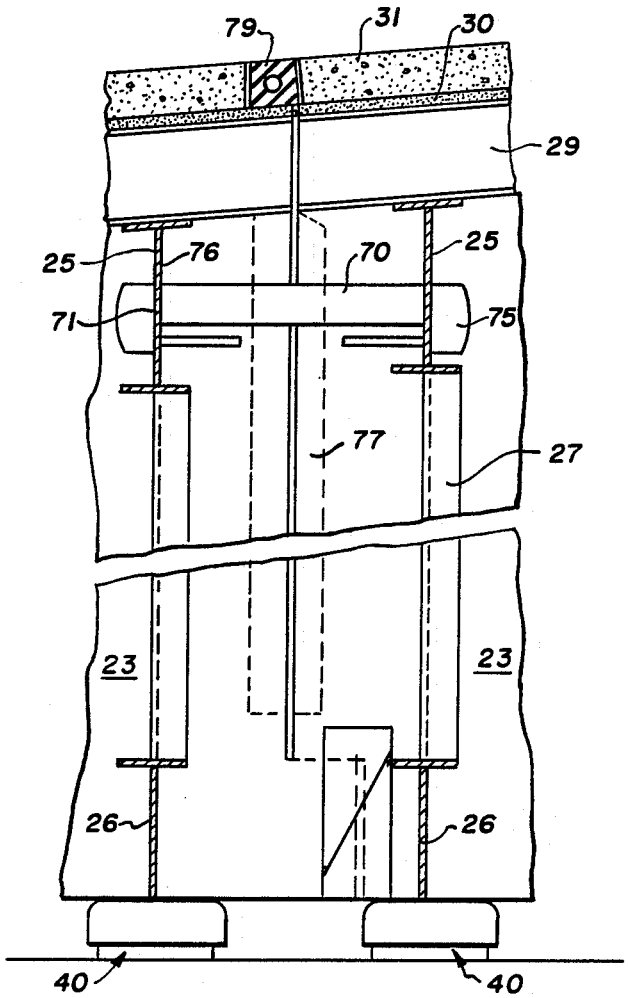
Fig. 19.

MODULAR OVERPASS OR RAISED PARKING STRUCTURE

FIELD OF THE INVENTION

This invention relates to the field of road construction and provides a modular support structure for use as an overpass system that allows for the quick and easy conversion of intersecting roadways into a junction in which one roadway passes over another. The present invention is particularly suited for converting a junction where a highway intersects with a secondary road into an overpass junction in which the highway passes over the secondary road.

DESCRIPTION OF THE PRIOR ART

Efficient flow of traffic is an increasingly difficult task as streets and roads are subjected to greater and greater traffic volumes. A solution to this problem has been to build overpass structures that allow a major road or highway to pass over a previously intersecting road. This arrangement avoids an intersection and traffic lights so that traffic is not constantly stopping and starting which results in long line ups. The invention of the present application is also useful as a railroad overpass to direct traffic over intersecting rail lines thereby avoiding long traffic disruptions when trains are crossing.

In a further embodiment, the present invention provides a raised parking lot structure that can be used to quickly and inexpensively expand parking space on existing lots.

Various prior art patents that allow for the construction of elevated roadways and overpasses are known. U.S. Pat. No. 4,181,995 to Zur teaches a modular structure for roadways. U.S. Pat. 4,592,673 to Lee teaches an elevated roadway interchange that provides for a nonstop and streamlined flow of freeway traffic. U.S. Pat. No. 3,662,656 to Finsterwalder discloses a bridge supporting structure useful with suspended roadways. U.S. Pat. No. 2,225,186 to Sorensen discloses a further example of an elevated highway structure that uses T-shaped columns supporting a road surface. These prior art structures are expensive to construct and generally require major modifications of the existing roads. Often, this major modifications requires a lengthy construction period up to several months long. In many cases, it is not possible to disrupt existing traffic patterns for long periods in an attempt to improve traffic flow in the long run.

SUMMARY OF THE INVENTION

In a first aspect, the present invention provides a modular overpass structure that is simple and inexpensive in construction and can be assembled on site in a very short time thereby minimizing any traffic disruptions. The present invention is a modular overpass comprising:

interlockable roadway sections including ramp sections adapted for fitting together to create entry and exit ramps, each ramp having a low end and a raised end; cantilever sections for attachment to said raised ends of said ramps, and spanning sections for joining said cantilever units;

flexible footings to support said roadway sections, said footings comprising a resilient base, a covering cap sealably fitted over said base to define a cavity, and packable bearing material partially filling said cavity; and anchoring means to maintain said roadway sections in position.

The modular overpass of the present invention is pre-fabricated in sections that align and lock together. The entire structure rests on flexible footings that are in contact with the existing roadway. The flexible footing arrangement of the present invention makes unnecessary the usual excavation and installation of concrete foundations for the ramps required in a normal overpass layout.

The modular overpass of the present invention can be used at virtually all highway intersections with appropriate modifications of the bases of the structure and the arrangement of the flexible footings to suit the pavement on which the overpass is to be erected.

The overpass can be designed to carry any specified load by using heavier steel for fabrication along with additional flexible footings to disperse the additional load.

The modular overpass of the present invention serves to maintain the flow of highway traffic—while local traffic on the formerly intersecting secondary road is controlled by traffic lights.

In a second aspect, the modular support structure of the present invention provides a raised parking surface that can be quickly and inexpensively erected over an existing lot. This modular support structure comprises:

interlockable raised platform units that define a raised surface;

flexible footings to support said interlockable raised platform units, said footings comprising a resilient base, a covering cap sealably fitted over said base to define a cavity, and a packable bearing material partially filling said cavity.

BRIEF DESCRIPTION OF THE DRAWINGS

Various aspects of the present invention are illustrated, merely by way of example, in the accompanying drawings, in which:

FIG. 18 is an partial longitudinal section through the modular overpass showing how two adjacent roadway units are joined together;

FIG. 19 is a detailed view of the connection of FIG. 18;

DESCRIPTION OF THE PREFERRED EMBODIMENTS

Figure 1:
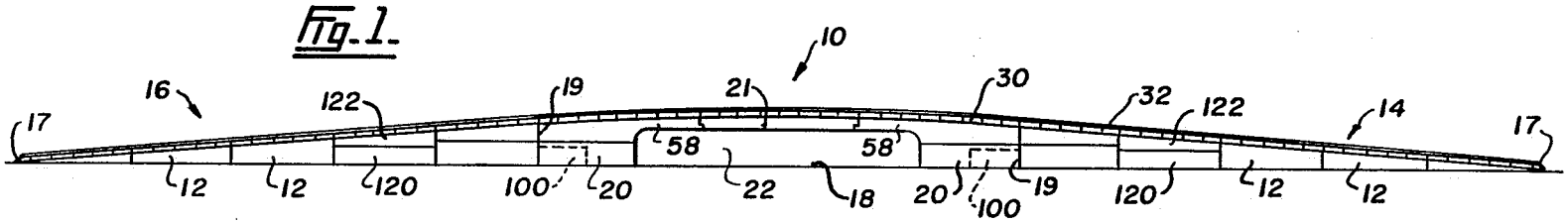
FIG. 1 is an elevation view of the modular overpass in an assembled state.
Figure 2:
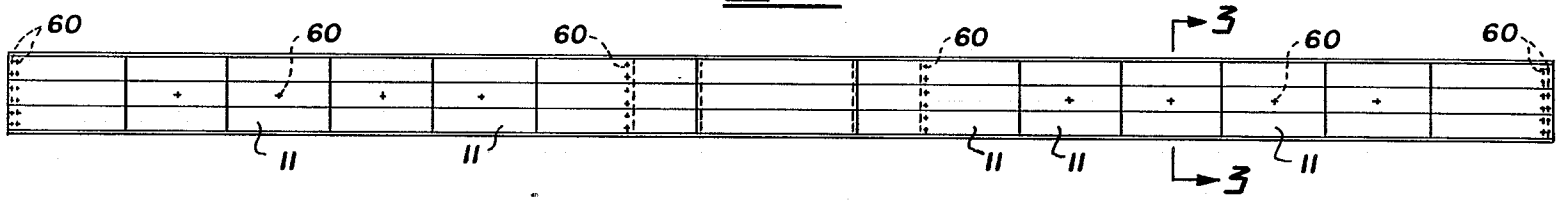
FIG. 2 is a plan view of the modular overpass.

Referring to FIGS. 1 and 2, there is shown a fully assembled modular overpass 10 according to an embodiment of the present invention. The overpass comprises a series of interlockable roadway units that can be classified into several groups. There are a plurality of ramp units 12 that are interconnected to form entrance and exit ramps 14 and 16, respectively. Each ramp 14 and 16 is connected to cantilever units 20 that support suspended span units 21. The cantilever units and the suspended span units combine to create a tunnel 22 which overlies the existing road to be bypassed.

The various roadway units of the modular overpass are linked end to end and side to side. The roadway units are joined end to end to create an overpass that extends along a longitudinal axis. In the present embodiment, as best shown in FIG. 2, the width of the overpass is formed using roadway units that are joined transversely of the longitudinal axis to form sections 11 of three units abreast. Obviously, the width of an overpass to be constructed can be varied by adjusting the width of individual roadway units or the number of units mounted together to form sections 11.

Figure 3:
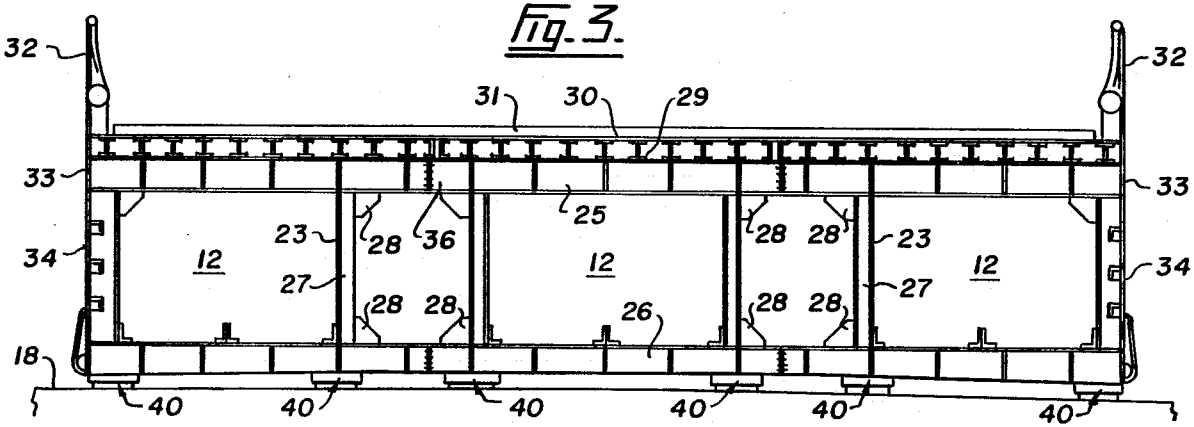
FIG. 3 is a cross-sectional view through the overpass taken along line 3—3 of FIG. 2 showing a typical ramp unit structure.

Each roadway unit comprises a pre-fabricated steel box unit constructed according to conventional techniques. FIG. 3, taken along line 3—3 of FIG. 2, is a cross-section through three transversely joined ramp units 12 and provides a view of typical structure of the various roadway units. Each roadway unit comprises a pair of parallel vertically aligned longitudinal bulkheads 23 that are connected by a plurality of upper and lower transverse beams 25 and 26, respectively which are egg-crated through the longitudinal bulkheads and welded in place. Vertically aligned stiffening members 27 are welded to bulkheads 23 and reinforcing gusset plates 28 extend between the bulkheads and the transverse upper and lower beams. Atop upper transverse beams 25 are affixed a series of longitudinally extending support beams 29 that support an inclined upper surface 30 as best shown in FIG. 1. The inclination of upper surface 30 determines the grade of the ramped roadway of the overpass. This grade is created by cutting the top edge of the vertical longitudinal bulkheads 23 along the length of each unit at the required angle. Inclined upper surface 30 supports a conventional road surface 31 of asphalt or like material. Alternatively, support beams 29 and upper surface 30 can be replaced by a corrugated sheeting surface having its corrugations aligned with the longitudinal axis of the overpass. Such a corrugated surface would be buried in concrete to provide a long lasting, wear resistant road surface. In the illustrated embodiment, road surface 31 is sufficiently wide to allow for two lanes of traffic with bicycle lanes provided adjacent guard rails 32. As previously mentioned, the width of an overpass to be assembled can be easily varied by modifying the number of units across the width of the overpass or by adjusting the dimensions of the individual roadway units.

The outermost sides 33 of each roadway section 11 are formed using exterior bulkheads 34 that protect the interior of the overpass from weather and provide a visually appealing appearance.

Upper and lower transverse beams 25 and 26 have ends 36 that extend beyond longitudinal bulkheads 23, and the ends 36 are provided with transverse locking means. The transverse locking means are shown in FIG. 3 as being bolts that connect together the ends 36 of adjacent beams.

Figure 17:
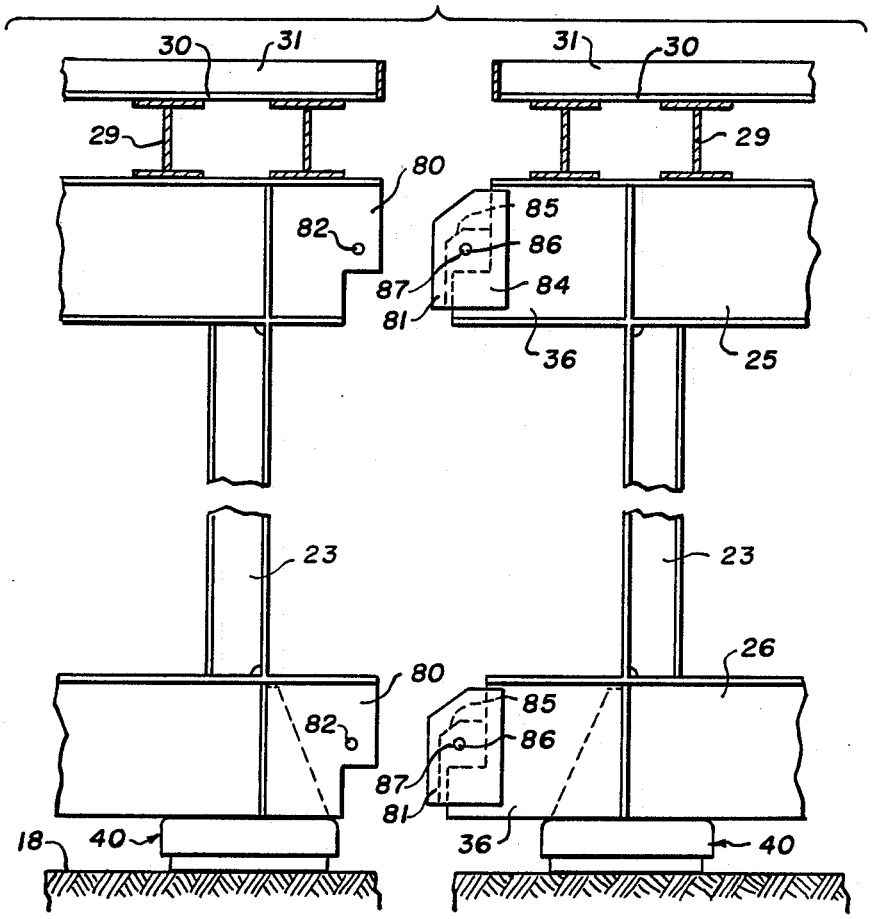
FIG. 17 is a partial transverse section through the modular overpass showing a connector for joining transverse beams.

Alternative transverse locking means are shown in FIG. 17. At each pair of beam ends to be joined, the ends are formed into interfittable tabs 80 and 81. First tab 80 is formed with an aperture 82 drilled therethrough and second tab 81 has overlapping cheek plates 84 attached to either side of the beam end to define a cavity 85 therebetween to accept first tab 80. Cheek plates 84 are formed with aligned apertures 86. In joining two roadway units transversely, first tab 80 is fitted between cheek plates 84 and into cavity 85 and a tapered locking pin 87 is driven into place. This arrangement offers the advantage that transverse connections can be made very easily and quickly and the inserted tapered pins are held in double shear to reduce the possibility of failure.

Figure 4:
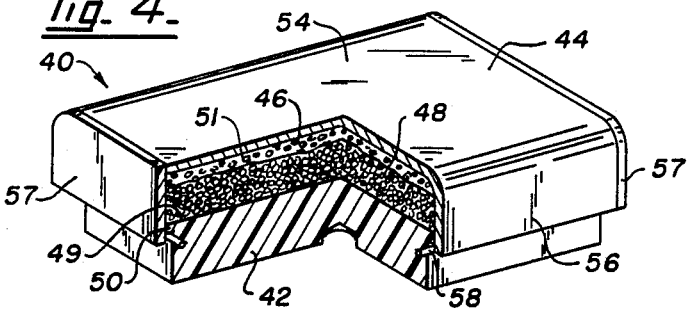
FIG. 4 is a sectioned view of a flexible footing used to support the modular overpass of the present invention.

The interlockable roadway units of the present invention are supported on flexible footings 40 that rest on the existing road surface 18. Footings 40 are welded to the underside of lower transverse beam 26 directly beneath longitudinal bulkheads 23. Referring to FIG. 4, the footings comprise a resilient base 42, preferably of neoprene, over which a covering cap 44 is sealably fitted. Resilient base 42 made also be made from urethane or other suitable resilient material. Covering cap 44 encloses a cavity 46 over top of resilient base 42 which is partially filled with a packable bearing material 48. A void space 51 is left in cavity 46 to allow for settling of the covering cap 44 on the resilient base 42 as the footings are loaded with the weight of the roadway sections. Preferably, packable bearing material 48 is fine gravel or the like.

Figure 5:
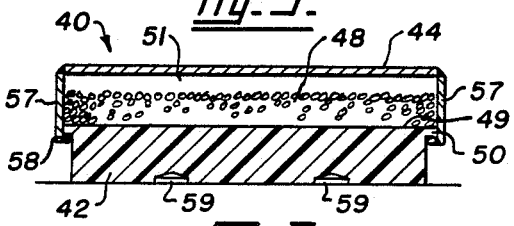
FIGS. 5 to 8 are various cross-sectional views of the flexible footing showing how the footing can accommodate different cambers and minor variations of the surface on which the overpass is erected.
Figure 6:
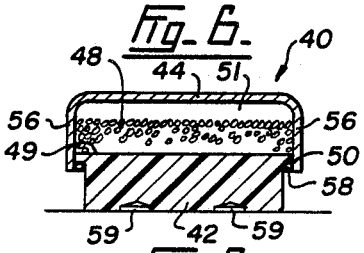

Resilient base 42 is formed with a top surface 49 having an upper flange 50 about the perimeter. Covering cap 44 comprises a top plate 54 with downwardly extending side walls 56. Covering cap 44 is preferably formed from a flat plate which has two opposed side edges flanged or bent downwardly into opposed side walls. When bent into such a shape the plate has an essentially shallow U-shaped cross section. Separate side plates 57 are then welded across the U cross section at either side of the plate to create the other two side walls. A continuous lower inner lip 58 extends from the side walls 56. This lip is best created by welding a rod to the lower interior perimeter edges of sidewalls 56. Covering cap 44 fits over the top surface 49 of resilient base 42 such that lower inner lip 58 engages beneath upper flange 50 as best shown in FIGS. 5 and 6. The engagement of flange 50 with lip 58 acts to sealably interlock base 42 and covering cap 44 while allowing for essentially vertical movement of the covering cap on the resilient base.

Preferably, in constructing flexible footings 40, cover plate 54 with flanged down side walls 56 and lower lip 58 is positioned over the resilient base 42 by sliding the U shaped cross section of the plate over the base such that lip 58 is below flange 50. A single side panel 57 is then welded in place along seam 53. The footing is then turned on its side and a measured amount of packable bearing material is poured into the space between the covering cap 44 and the resilient base 42. The second separate side panel 57 is then welded into place along seam 53 to complete the covering cap.

FIGS. 5 and 6 show side and end views, respectively, of a flexible footing 40 in its unloaded state. Note that resilient base 42 is provided with a plurality of cavities 59 formed on its lower surface. When flexible footing 40 is fully loaded, resilient base 42 is slightly distorted and these cavities act to create a suction grip on the road surface on which they are placed.

Figure 9:
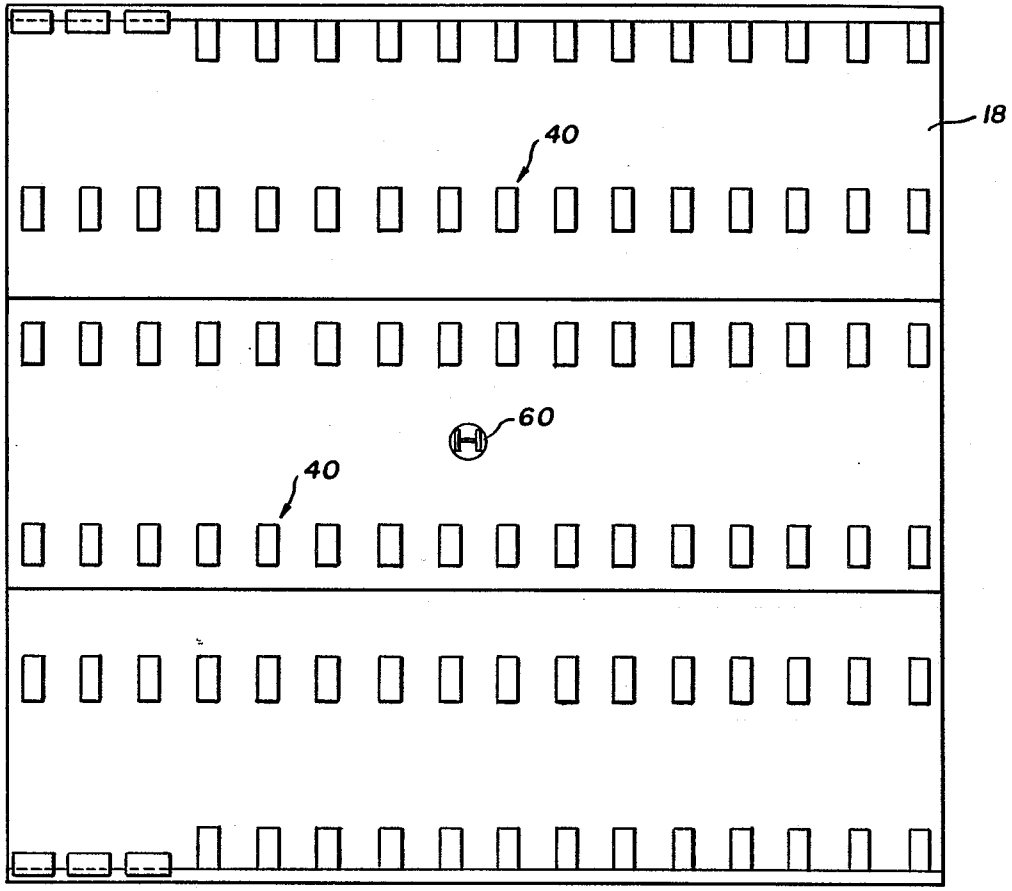
FIG. 9 is a schematic view showing the arrangement of the flexible footings for three of the ramp sections of the present invention.

FIG. 9 shows an example of a layout of flexible footings 40 as they would rest on an existing road surface 18 when supporting three ramp units 12 abreast. The total number and placement of the footings depends on the load of the overpass to be constructed. On the outer units some of the flexible footings are rotated through ninety degrees. This is to allow for clearance of the wheels of a transporting trailer when moving the units as will be explained later. In the illustrated arrangement three ramp units joined side by side are supported on 96 footings. If each of the 96 resilient base has an area of 1.3 square feet and the bases are loaded at 3 tons per square foot, equivalent to 46 lbs per square inch, the 96 bases will be capable of supporting 374 tons. A desirable arrangement of flexible footings is pairs of footings positioned welded to each lower transverse beam 26 directly beneath longitudinal bulkheads 23 along the length of a ramp section. Each flexible footing is welded by cover cap 44 to lower transverse beam 26.

Figure 7:
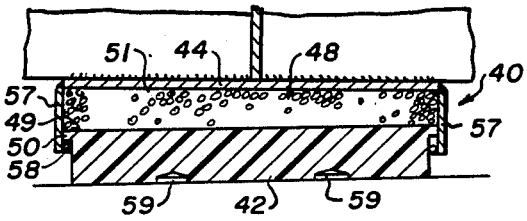
Figure 8:
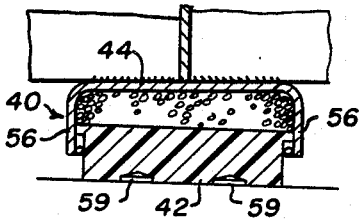

Flexible footings 40 are not intended to accommodate major variations in the road surface on which the modular overpass is placed. Each roadway unit is specially fabricated to fit a specific location on the existing roadway 18. In constructing a roadway unit, a surveyor's transit readings are taken of the existing road surface to determine the height, grade, and camber at the centre of each flexible footing. These measurements are then transferred to the base of a roadway unit and lower transverse beams 26 are shaped to conform essentially to the road surface on which the particular roadway unit is to be placed. The flexible footings are designed to accommodate minor variations in the existing roadway 18. For example, FIGS. 7 and 8 illustrate how flexible footing 40 is able to accommodate variations in the camber of the existing road surfaces 18. Most road surfaces are built with some degree of camber. When a roadway unit is lowered onto its flexible footing, void space 51 disappears as covering cap 44 moves downwardly with respect to base 42 thereby compacting gravel 46. Gravel 48 is evenly distributed by the weight of the roadway section throughout cavity 46.

Figure 16:
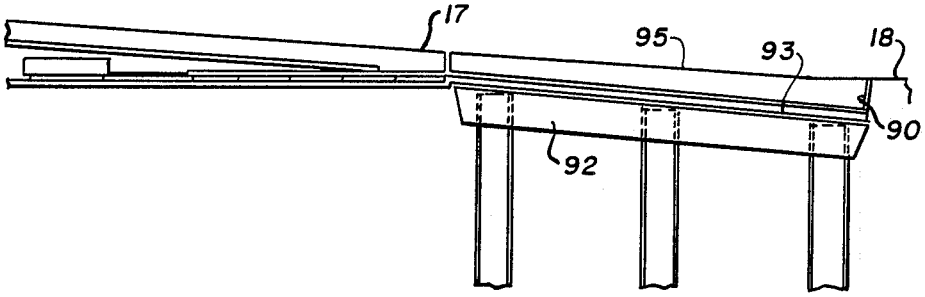
FIG. 16 is a section view showing the pit at the end of each ramp section.

Ramp units 12 are arranged on flexible footings 40 in the manner previously described to create entry and exit ramps 14 and 16, each having a low end 17 that smoothly merges with the existing road surface 18, and a raised end 19. As best shown in FIG. 16, there is a pit 90 dug in the existing roadway 18 adjacent low end 17. This pit holds a transition surface 95 that provides a smooth and gradual transition between the existing road surface 18 and the ramp of the modular overpass.

Figure 10:
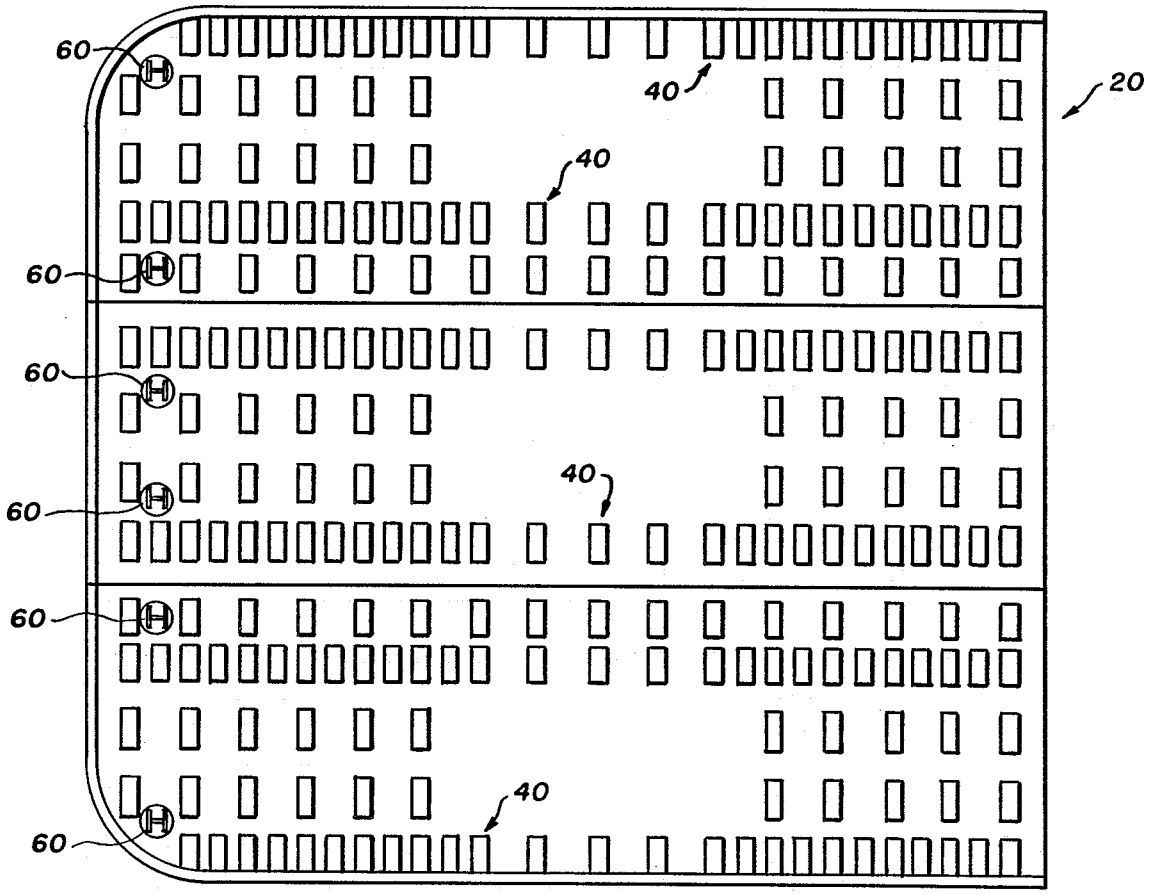
FIG. 10 is a schematic view showing the flexible footing arrangement for the cantilever units.

Cantilever units 20 are attached to raised ends 19 of each ramp. Cantilever units 20 are constructed using the same box structure as shown in FIG. 3 except that cantilever extensions 58, as shown in FIG. 1, are also provided. In addition, cantilever units 20 are provided with internal ballast weights 100 (shown in dashed lines in FIG. 1) in order to support suspended span units 21. Cantilever units 20 are required to support their own weight, the weight of the suspended span units and the ballast weights and therefore, it is desirable that additional flexible footings be provided to support the cantilever units. FIG. 10 shows a typical layout of flexible footings 40 on a road surface 18 to support the cantilever sections. There are 163 flexible footings 40 in the arrangement shown. If each footing is 1.3 square feet in area, and loaded to 46 pounds per square inch or three tons per square foot, the arrangement shown can support approximately 635 tons. Suspended span sections 21 are suspended between extensions 58 in a conventional manner.

FIG. 10 also shows the anchoring means used with the present invention. These anchoring means comprise buried pilings 60 adjacent the end of the cantilever units from which extensions 58 project adapted to interfit with piling engagement means on the roadway units. Anchoring means are also found in pit 90 adjacent low end 17 of ramps 14 and 16, and centrally beneath certain roadway units. In the present embodiment, as best shown in FIG. 2, the anchoring means are centrally positioned below the middle unit of each section 11 which allows some freedom of movement for the ends of the unit due to heating and cooling expansion and contraction. The pilings and piling engagement means act to anchor the entire modular overpass structure in position.

Figure 12:
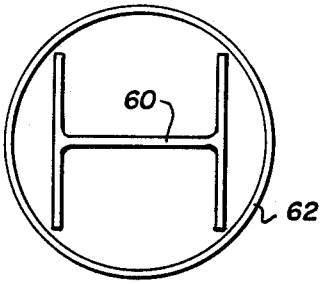
FIG. 12 is a top view of the piling of FIG. 11.
Figure 11:
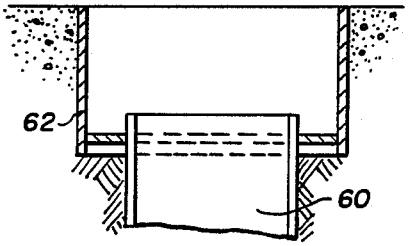
FIG. 11 is a view through a piling of the anchoring means used to stabilize the modular overpass showing the upper collar.

FIG. 11 shows a typical piling 60 used for anchoring cantilever units 20. The piling is a conventional wide flange beam driven vertically into the ground. There is an upper collar 62 that is welded to the piling after it has been driven, the upper collar also being buried into the ground such that the upper edge 64 of the collar is level with the existing road surface. As shown in FIG. 12, collar 62 defines a circular cavity when view from above.

Figure 14:
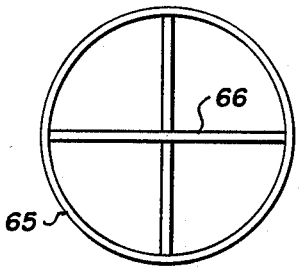
FIG. 14 is a plan view of the sleeve member of FIG. 13.
Figure 13:
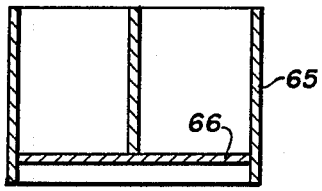
FIG. 13 is a view through a sleeve member insertable into the collar of FIG. 11.

Preferably, there is a rigidly attached upwardly extending sleeve 65 which is dimensioned to fit within collar 62. As shown in FIGS. 13 and 14, sleeve 65 has internal webbing 66 to strengthen the sleeve.

Figure 15:
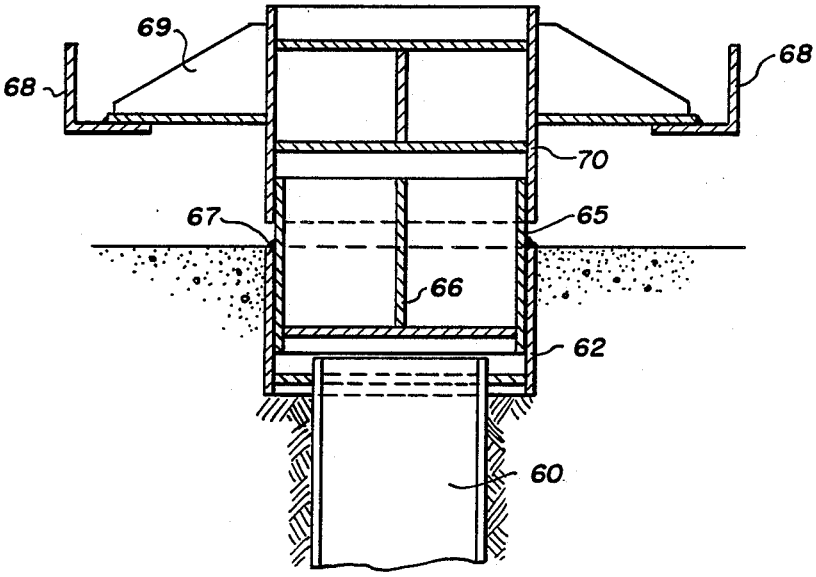
FIG. 15 is a section view showing a piling and collar, a sleeve member and a downwardly extending member of a roadway section interfitted together to form an anchoring site to prevent lateral movement and to allow for vertical movement.

FIG. 15 illustrates how sleeve 65 is fitted into collar 62 and welded into place about seam 67. This operation would be performed just prior to lifting the roadway units into place. Before erecting the overpass, collar 62 would be filled with a removable plug so that the existing road surface 18 would be usable by traffic before erection of the modular overpass. Sleeve 65 is designed to align with and slidably engage piling engagement means mounted below a roadway unit comprising a hollow alignable downwardly extending member 70. The piling engagement means also includes a pair of support rails 68 attached between a pair of adjacent lower transverse beams 26. Downwardly extending member 70 has opposed flanges 69 that engage and slide on these support rails. At the erection site, downwardly extending member 70 can be slid along rails 69 to ensure proper alignment with piling 60. Field welds between flanges 69 and rails 68 are then made to secure the downwardly extending member 70 to the roadway unit. This anchoring arrangement acts to prevent lateral motion of the roadway structures but allows for small vertical movements that would arise due to passage of traffic over the modular overpass.

The piling arrangement of FIG. 15 is used beneath cantilever units 20 at the positions indicated in FIG. 10. Adjacent low end 17 of ramps 14 and 16, wide flange pilings 60 are driven into pit 90 below the existing roadway surface 18 as shown in FIG. 16. The pilings are welded to an angle bar header 92 onto which a flat plate 93 that supports a road surface is plug welded. The road surface is bolted down to the bar header. This arrangement provides a smooth transition from the existing road surface 18 to the modular overpass of the present invention.

As previously mentioned, the various roadway units of the present invention can be connected together transversely to form sections by bolting or using a tapered pin arrangement. In order to connect roadwaY units end to end, means for longitudinal locking of the roadway units are provided. Referring to FIGS. 18 and 19, there is shown means for longitudinal locking of roadway units comprising slots 71 formed in the upper transverse beam 25 and a link member 70 adapted to engage in corresponding slots of two adjacent roadway units. Bracing brackets 73 extend between longitudinal bulkheads 23 and upper transverse beam 25 adjacent each slot. Once inserted in slots 71, member 70 is slid downwardly such that enlarged ends 75 of the link engage against the outer faces 76 of upper transverse beams 25 to hold the adjacent roadway units together.

Longitudinal locking means can also be formed in the vertical stiffening members 27 affixed to bulkheads 23 by forming the necessary slots in these members. A single longitudinal locking means is shown in FIGS. 18 and 19, however, upper and lower locking means are also possible.

To assist in aligning the roadway units when connecting them longitudinally, bulkheads 23 are formed with overlapping plates 77 that are welded to the outer face of the bulkhead and extend past its edge. Plates 77 on each side of a first roadway unit engage against the outer faces of an adjacent second unit and act to guide the second unit into alignment with the first. As is evident in the drawings, an essentially vertical gap is provided between bulkheads of adjacent joined units to allow for expansion of the units.

FIG. 19 provides a detailed view of a longitudinal joint between adjacent units. The longitudinal joint between road surfaces 31 of any two adjacent roadway units is filled with a resilient member 79, preferably made from neoprene, which is a molded member that is placed in position at a compression strip.

The modular overpass of the present invention can be quickly and easily installed at any junction where it is desired for one road to pass over a second road at an intersection between the two.

Initial preparations involve a survey team measuring, locating and aligning the position of the proposed overpass structure. This work would include taking transit readings of the road surface on which the roadway sections are to be placed to determine the placement for the flexible footings. This work would be done for one side of the roadway at a time, thereby leaving a part of the road open at all times for continued traffic flow. Based on the survey results, the roadway units to create the desired overpass would be constructed.

At a later date, a series of partial road closures would be required so that pilings can be driven and the pits for the end of entry and exit ramps 14 and 16 dug. Disturbed paving would be replaced and temporary plugs inserted into the pits and piling holes.

Figure 21:
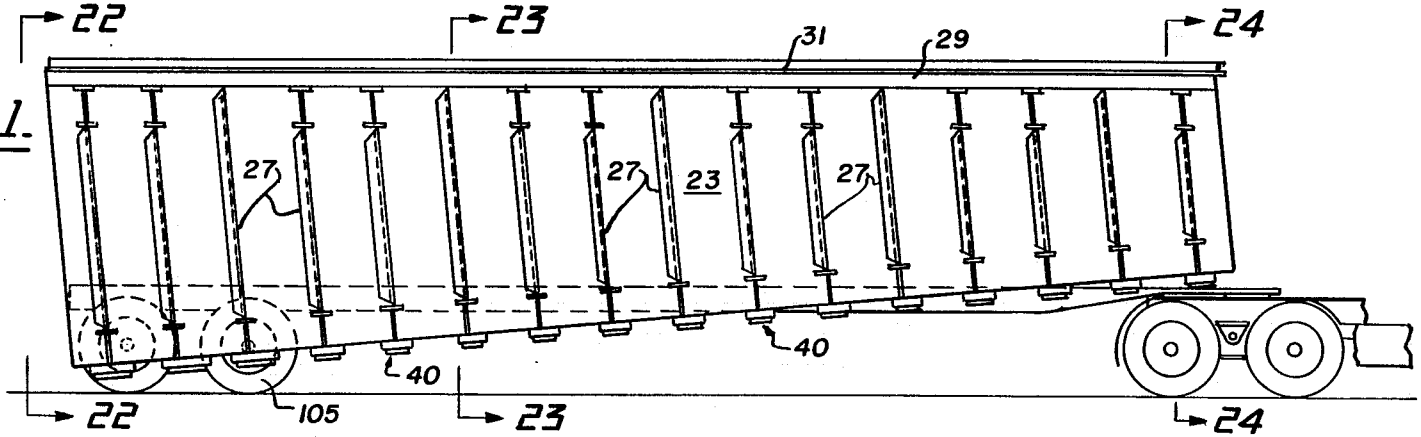
FIG. 21 shows a section of the overpass, as it would appear loaded onto a conventional truck and container trailer.
Figure 24:
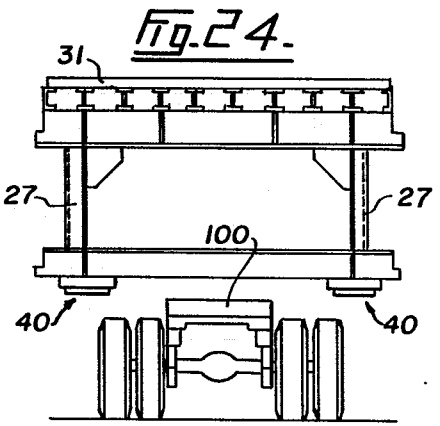
FIG. 24 is a section view taken along line 24—24 of FIG. 21.
Figure 23:
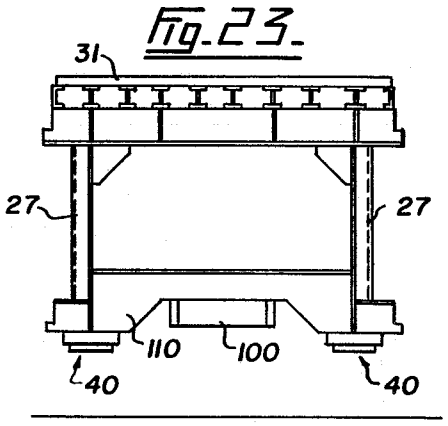
FIG. 23 is a section view taken along line 23—23 of FIG. 21.
Figure 22:
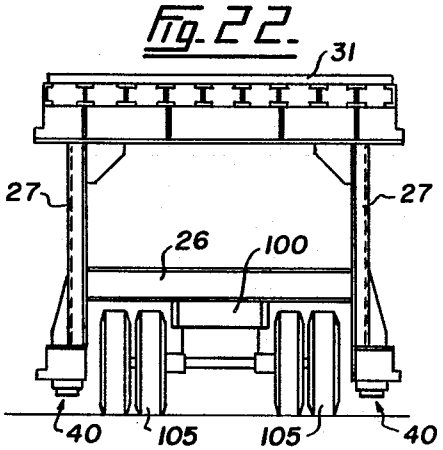
FIG. 22 is a section view taken along line 22—22 of FIG. 21.

It is desirable that the units of the present invention be easily transportable on conventional container trailers so that the units can be quickly shipped from a remote construction site to the actual erection site of the modular overpass. FIG. 21 shows a fully assembled roadway unit 12 positioned on a conventional truck trailer 100. The unit includes attached flexible footings 40. FIGS. 22, 23 and 24 are section views taken along the indicated lines of FIG. 21 showing how lower transverse beams 25 are positioned along the length of the unit to allow the unit to be mounted on the trailer such that upper road surface 31 is level. This ensures that a truck carrying roadway units will be able to make it under exiting overPasses on the highway when transporting the units to the construction site. FIG. 22 shows a lower transverse beam 25 that is raised above the base of the roadway unit to accommodate the rear wheels 105 of the trailer. Gusset plates 107 connect the transverse beam to separate end portions 109. FIG. 23 shows a lower transverse beam having a cutout section 110 to accommodate the trailer body 100. FIG. 24 shows an unmodified lower transverse beam 25 that is supported above the trailer body. As previously shown in FIG. 9, it may be necessary to rotate some or all of the flexible footings to provide clearance for the wheels of the transport trailer.

Transporting the roadway units on truck trailers may also make it necessary to divide taller units into a base unit and an upper unit so that the unit does not exceed a height that makes travel on roads impossible due to bridges and overpasses. As shown in FIG. 1, the base unit 120 would be essentially rectangular and fitted with flexible footings 40. Upper unit 122 would be stackable on top of the base unit and would have a graded upper surface to support road surface 31. The base unit and upper unit would be bolted together in a conventional manner. In addition, overlapping plates similar to plates 77 shown in FIG. 19 can be used to ensure quick alignment of the units as they are stacked.

Figure 20:
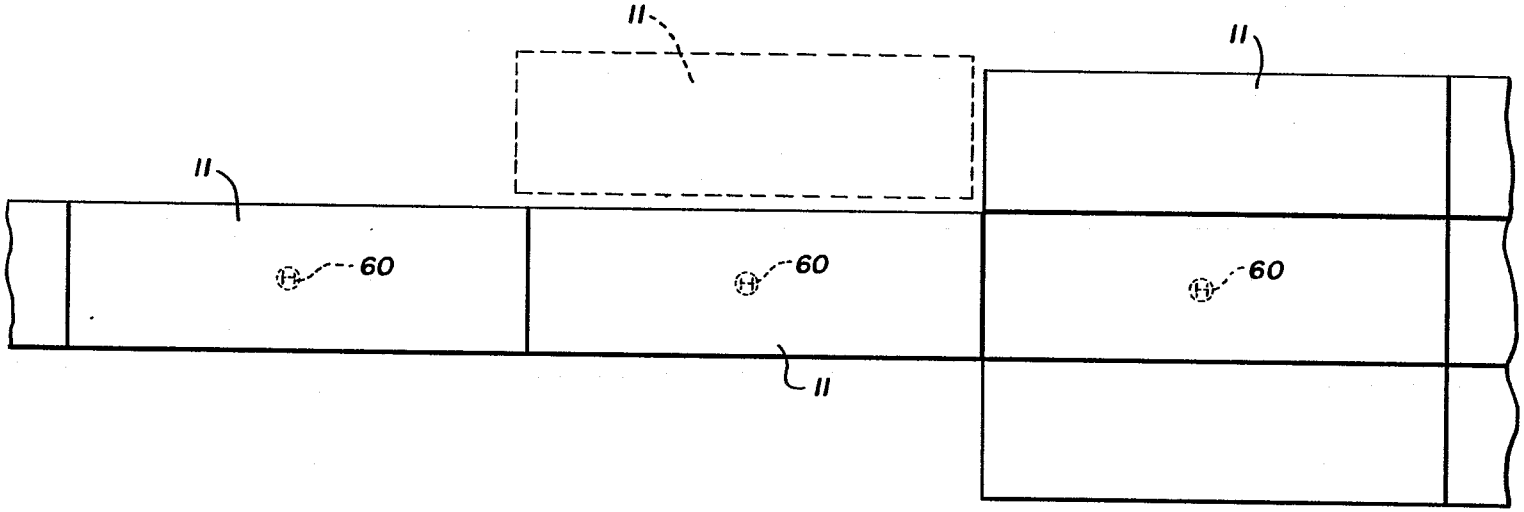
FIG. 20 is a plan view showing the erection sequence of the overpass of the present invention.

Actual installation of the roadway units involves lifting the various units into place using cranes. Preferably, the units are pre-formed with bolt holes into which eye bolts are removably screwed to provide attachment points for the lifting rigging of the crane. As shown in FIG. 20, the centre units 12 of each section are placed in position to create a narrow overpass structure. Subsequently, trucks hauling units would drive up centre sections and cranes would unload the units and drop them into place on either side of the centre units to create sections of three units abreast. Using the quick and efficient transverse and longitudinal locking arrangements of the present invention the modular overpass can be installed in a relatively short period.

The modular overpass of the present invention provides a simple, economical overpass structure that can be installed on an existing highway at designated intersections. The structure uses pre-fabricated steel units, pre-fitted and completely finished at a remote site to include guard-rails, flexible footings, coatings, paving and traffic lane markings. These complete units are then transported to an erection site for final assembly with minimal disruption to traffic flow.

Figure 25:
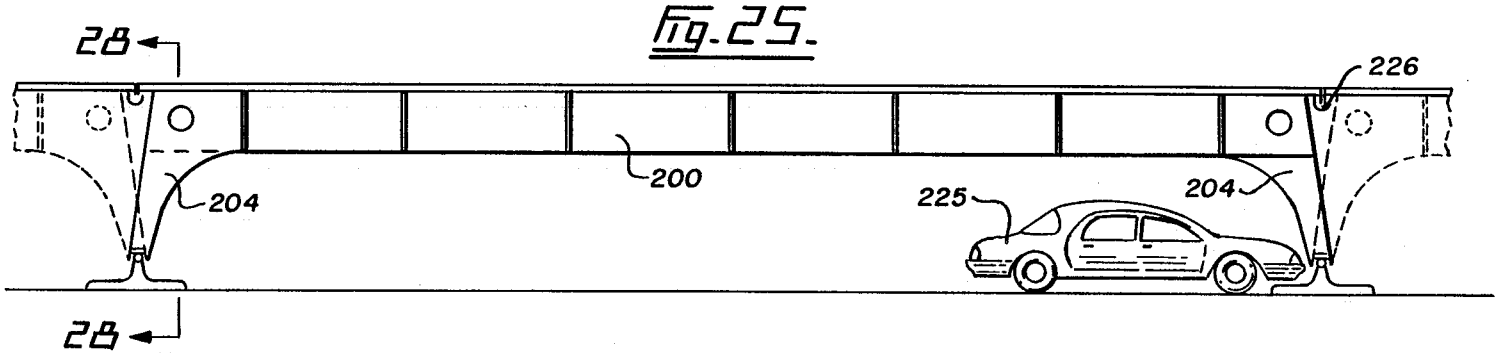
FIG. 25 is an elevation view of a raised parking lot structure showing a series of interconnectable raised platform units.
Figure 26:
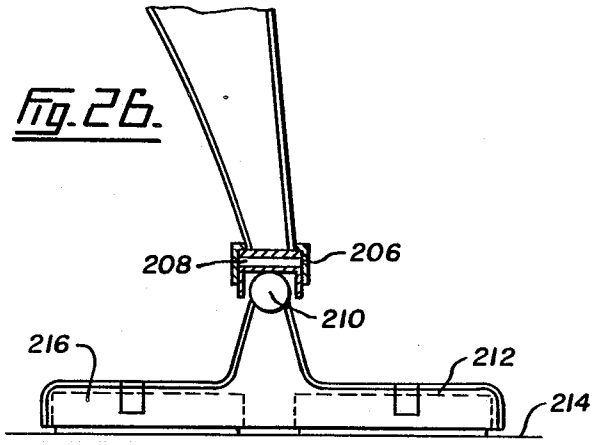
FIG. 26 is a section view taken through a support extension of a raised platform unit showing the pivotable joint means.
Figure 27:
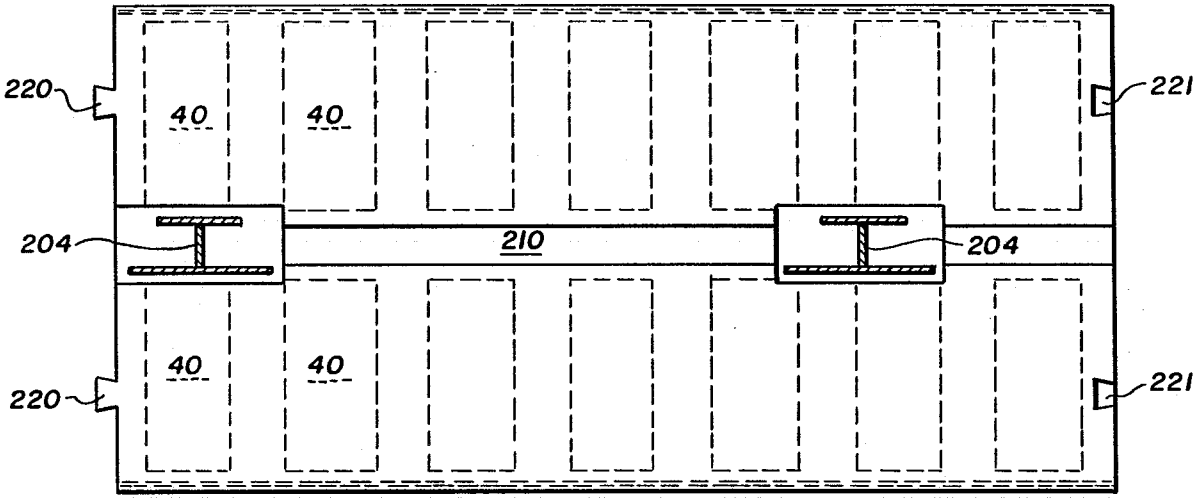
FIG. 27 is a plan view of a support member showing the internal arrangement of flexible footings within the support member.

A second embodiment of the present invention is shown in FIGS. 25 to 27 and comprises a raised parking surface that can be constructed over an existing parking lot to greatly increase available parking spaces.

As shown in FIG. 25, the raised parking surface comprises a series of interconnectable raised platform units 200 constructed from steel beams and panels according to conventional techniques. The surface 202 of each platform unit is preferably formed with a slight camber to allow for efficient drainage.

Each raised platform is formed with support extensions 204 extending downwardly and outwardly from each corner. As best shown in FIG. 26, the distal end of each extension is formed into an inverted U-shaped cavity 206 formed from an inverted channel bar. A shock absorbing member 208 of neoprene or like hard, resilient material can be included in the U-shaped cavity.

The U-shaped cavity of each support extension are adapted to engage a support rail 210 of support member 212 which rests on the existing parking lot surface 214. Support rail 210 is a solid round bar or heavy pipe. The result is an inverted saddle joint between raised platform units 200 and support members 212 that can allow for some variation in the level of the surface on which the structure is built. At one end of the raised platform unit, the inverted saddle joints are held tightly on rail 210 by inserting permanent spacers into the U-shaped cavity. At the opposite end of the unit, the inverted saddle joint is free to move slightly on rail 210 to allow for changes due to expansion and contraction.

Figure 28:
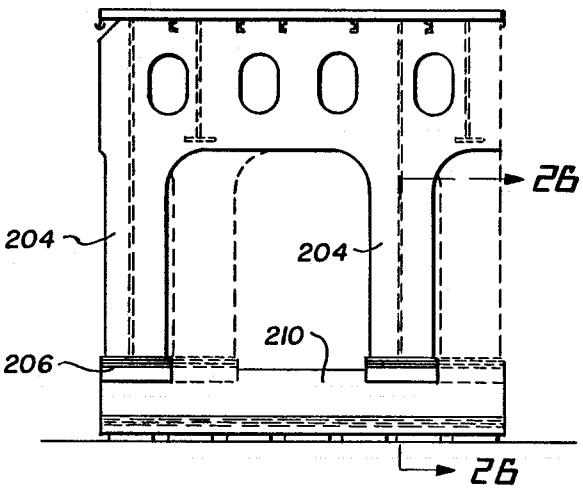
FIG. 28 is a section view taken along line 28—28 of FIG. 25 showing the end structure of a raised platform unit.

FIG. 27 provides a plan view of a support member 212 and shows by dashed lines the placement of flexible footings 40, identical to those used in the modular overpass, within the hollow base 216 of the support member. Each end of the support member is formed with either projections 220 or cavities 221 adapted to engage with corresponding structures on an adjacent support member to form a row of interconnected support members having a continuous support rail 210 to support a series of raised platform units. As best shown in FIG. 25 and 28, a pair of spaced rows of support members 210 can support row of interconnectable raised support platforms. By adding further spaced rows of support members, additional raised platform units can be added as shown by dashed lines in FIG. 25. FIG. 28 which is a section along line 28—28 of FIG. 25 shows how the support extensions 204 at each end of a raised platform unit 200 are offset to allow the extensions of adjacent units to interfit between each other on support rail 210.

The apparatus of the present embodiment provides a relatively inexpensive and quick way to convert an existing parking lot into a two tiered lot with a substantial increase in parking spaces available. As shown in FIG. 25, cars 225 can be parked under cover of the raised platform units or the upper surface can be used. Necessarily, ramp units as described in the modular overpass embodiment are used to provide access to the upper parking surface. Drainage culverts 226 can also be suspended between adjacent platform units to provide a water collection system that prevents dripping beneath the units.

Although the present invention has been described in some detail by way of example for purposes of clarity and understanding, it will be apparent that certain changes and modifications may be practiced within the scope of the appended claims.

I claim:

1. A modular overpass for vehicular traffic comprising:

interlockable roadway units including ramp units adapted for fitting together to create entry and exit ramps, each ramp having a low end and a raised end; cantilever units for attachment to said raised ends of said ramps, and suspended span units for joining said cantilever units;

flexible footings to support said roadway units, said footings comprising a resilient base, a covering cap sealably fitted over said base to define a cavity, and a packable bearing material partially filling said cavity; and anchoring means to maintain said roadway units in position.

2. A modular overpass as claimed in claim 1 in which said interlockable roadway units comprise pre-fabricated steel box units, each unit being formed from a pair of parallel vertically aligned longitudinal bulkheads having a plurality of upper and lower essentially horizontal transverse beams extending between said bulkheads, and stiffening members attached to said bulkheads, said upper transverse beams supporting a road surface and said lower transverse beams having attached flexible support means.

3. A modular overpass as claimed in claim 2 in which said upper and lower transverse beams have ends that extend beyond said longitudinal bulkheads, said ends having means for transverse interlocking of said roadway units.

4. A modular overpass as claimed in claim 3 in which said means for transverse interlocking of said roadway units comprises bolting said ends together.

5. A modular overpass as claimed in claim 3 in which said means for transverse interlocking of said roadway units comprises first and second interfittable tabs, an aperture through said first tab, overlapping cheek plates with aligned apertures therethrough attached to either side of said transverse beam adjacent said second tab defining a cavity to accept said first tab such that said apertures are all aligned, and a tapered locking pin insertable through said aligned apertures to interconnect said beam ends together.

6. A modular overpass as claimed in claim 2 in which said stiffening members of said longitudinal bulkheads include means for longitudinal locking of said roadway units.

7. A modular overpass as claimed in claim 6 in which said means for longitudinal locking of said roadway units comprises slots formed in said stiffening members and said upper and lower transverse beams, and a link member adapted to engage in corresponding slots of two adjacent roadway units to extend between and interlock said units.

8. A modular overpass as claimed in claim 2 in which said roadway units include essentially rectangular base units on which are mounted upper units comprising said ramp units or said cantilever units.

9. A modular overpass as claimed in claim 1 in which said anchoring means comprises a series of steel pilings driven into the ground and piling engagement means in said roadway units to engage said pilings.

10. A modular overpass as claimed in claim 9 in which said steel pilings are formed with an upper collar, and said piling engagement means mounted to said roadway unit comprises an alignable downwardly extending member adapted to engage with said upper collar to prevent lateral movement of said roadway unit but allow for vertical movement.

11. A modular overpass as claimed in claim 10 in which said piling engagement means comprises a pair of longitudinally extending support rails attached between a pair of adjacent lower transverse beams, said downwardly extending member having flanges to engage said support rails such that said member is supported between said rails whereby said downwardly extending member can be moved on said support rails for proper alignment with a steel piling whereupon said flanges are welded to said support guides to rigidly position said downwardly extending member to said roadway unit.

12. A modular overpass as claimed in claim 10 in which said upper collar includes a rigidly attached upwardly extending sleeve, and said downwardly extending member is hollow and adapted to fit over said upwardly extending sleeve.

13. A modular overpass as claimed in claim 9 in which said anchoring means are positioned centrally beneath each roadway unit, at the low ends of said ramps, and adjacent said cantilever units.

14. A modular overpass as claimed in claim 9 in which said low ends of said ramps are formed with a pit between said ramp unit and the existing roadway into which said steel pilings are driven to support a transition surface.

15. A modular overpass as claimed in claim 1 in which said resilient base of said flexible footings has a top surface formed with an upper flange about the perimeter thereof.

16. A modular overpass as claimed in claim 15 in which said covering cap comprises a top plate with downwardly extending side walls having a continuous lower inner lip, said covering cap being positioned over said top surface of said base such that said lower inner lip engages beneath said upper flange of said resilient base to interlock said base and said covering cap while allowing for essentially vertical movement of said covering cap on said resilient base, said covering cap defining a cavity between said top surface of said base and said top plate of said covering cap.

17. A modular overpass as claimed in claim 15 in which said resilient base is made from neoprene.

18. A modular overpass as claimed in claim 15 in which said resilient base is made from urethane.

19. A modular overpass as claimed in claim 15 in which said resilient base is formed with cavities on its lower surface adapted to create a suction attachment to said existing roadway.

20. A modular overpass as claimed in claim 1 in which said packable bearing material is fine gravel.

21. A modular overpass as claimed in claim 1 including ballast means as a counterweight for said cantilever units.

22. A modular support structure for parked cars comprising:

interlockable raised platform units that define a raised surface;

flexible footings to support said interlockable raised platform units, said footings comprising a resilient base, a covering cap sealably fitted over said base to define a cavity, and a packable bearing material partially filling said cavity.

23. A modular support structure as claimed in claim 22 in which said flexible footings are located in interlockable support members having saddle joint means, and said interlockable raised platform units are formed with support extensions adapted to engage said saddle joint means.

24. A modular support structure as claimed in claim 22 including ramp units to provide access to said raised surface.

* * * * *